United States Patent [19]

Burke

[11] 4,035,630

[45] July 12, 1977

[54] ARTICLE OF JEWELRY

[76] Inventor: John G. Burke, 4516 E. 46th St., Indianapolis, Ind. 46226

[21] Appl. No.: 590,601

[22] Filed: June 26, 1975

[51] Int. Cl.[2] ..... F21V 33/00

[52] U.S. Cl. ..... 240/6.4 W; 240/59

[58] Field of Search ..... 240/6.4 W, 59; 313/499; 315/200 A; 331/108 A

[56] References Cited

U.S. PATENT DOCUMENTS

| | | | |
|---|---|---|---|
| 3,508,041 | 4/1970 | Sweany et al. | 240/59 X |
| 3,521,049 | 7/1970 | Young | 240/59 X |
| 3,624,384 | 11/1971 | Ledingham | 240/59 X |
| 3,737,647 | 6/1973 | Gomi | 240/59 X |
| 3,795,830 | 3/1974 | Richardson | 313/499 X |
| 3,818,209 | 6/1974 | Roth | 240/59 |
| 3,901,121 | 8/1975 | Kleiner | 240/59 |

*Primary Examiner*—Robert K. Schaefer
*Assistant Examiner*—Vit W. Miska
*Attorney, Agent, or Firm*—Woodard, Weikart, Emhardt & Naughton

[57] ABSTRACT

A decorative article for wearing on the clothing and having light emitting diodes thereon, which alternately flash on and off. A button with a decorative design on its face has two or more light emitting diodes mounted for display on the forward face of the button. The button has attached thereto a pair of pins which project through the clothing of the wearer and are received in a pair of female tie tack clasps. Each tie tack clasp is electrically connected to one of a pair of insulated wires which lead to a battery-powered oscillator circuit carried out of sight on the person of the wearer. The pair of light emitting diodes are connected electrically in parallel between the pins with the anode of one diode connected to the cathode of the other diode and the cathode of the one diode connected to the anode of the other.

2 Claims, 8 Drawing Figures

ARTICLE OF JEWELRY

BACKGROUND OF THE INVENTION

1. Field of the Invention

This invention relates to an article of jewelry for wearing on the clothing and incorporating lights.

2. Description of the Prior Art

A number of devices have been conceived for wearing on the body which incorporate lights. Examples of such devices are shown in the U.S. Pat. Nos. to Ellerbe, 3,564,232; to Jones, 2,962,580; to Frasca, 3,814,926; and to Wood, 3,384,740. It has been found desirable to design a device of this type to incorporate two or more lights and to provide a signal to the lights in such a way as to cause the two lights to alternately flash. Such a device is shown in the U.S. Pat. No. to Richey, 3,866,035. The device of the patent to Richey, however, requires that the pins of the article of jewelry be precisely located in mating connectors. It is desirable that an improved manner of mounting the decorative article be provided whereby easily connectable tie tack clasps can be used for receiving the pins and mounting the article on the clothing.

SUMMARY OF THE INVENTION

The present invention involves a decorative article for wearing on the clothing including at last one light emitting diode. A button is provided for display on the clothing and has the light emitting diode mounted for display on the button. A pair of pins are attached to and projecting from the button for mounting the button on the clothing. One of the pins is electrically connected to the cathode of the diode and the other of the pins is electrically connected to the anode of the diode. A pair of female fastener members are both adapted to receive either of the pins for attaching the button to the clothing. The device includes means for providing an electrical signal to the female fastener members which signal causes a first of said members to have a positive voltage relative to a second of said members and then causes the second of said members to have a positive voltage relative to the first of said members.

It is one object of this invention to provide an improved article of jewelry with a light display.

Another object of this invention is to provide an article of jewelry incorporating a light display which is easily mounted on the clothing.

DESCRIPTION OF THE PREFERRED EMBODIMENT

Figure 1:
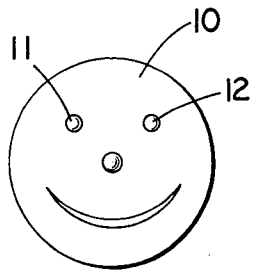
FIG. 1 is a front elevation of a decorative article otherwise known as a "smile button" embodying the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
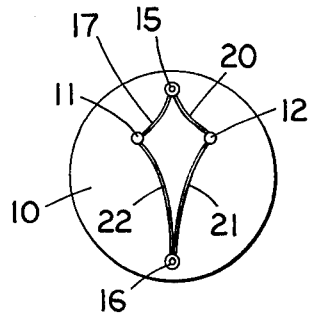
FIG. 2 is a rear elevation of the "smile button" of FIG. 1.
Figure 3:
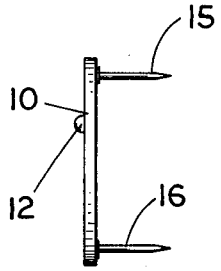
FIG. 3 is a side elevation of the structure illustrated in FIGS. 1 and 2.

Referring now more particularly to FIG. 1, there is illustrated a smile button 10 which can be worn on the lapel or the like and which includes a pair of light emitting diodes 11 and 12. The circuit of the present invention is so arranged that the light emitting diode 11 first is turned on and diode 12 off, and then the light emitting diode 12 is turned on and the diode 11 off, and the cycle repeats itself. In FIG. 2 the rear side of the button 10 is illustrated and has mounted thereon a pair of pins 15 and 16. The pins 15 and 16 are attached to the rear surface of the button 10 by means of nonconductive epoxy so that the pins 15 and 16 are electrically isolated from one another. Alternatively, either one of the pins 15 or 16 might be electrically connected to the button 10.

FIG. 2 also illustrates a portion of the electrical circuit of the present invention including the wires 17, 20, 21 and 22. It can be seen from FIG. 6 that the wires 17, 20, 21 and 22 connect the pins 15 and 16 and the light emitting diodes 11 and 12 in such a manner that the cathode of the diode 12 is connected to the anode of the diode 11 and the anode of the diode 11 is connected to the cathode of the diode 12. Also the pins 15 and 16 are connected by the wires 17, 20, 21 and 22 to the opposite terminals of the light emitting diodes 11 and 12. This circuit as illustrated in FIGS. 2 and 6 causes the lighting circuit to be operable no matter which pin 15 or 16 is connected to the female tie tack clasp 25 and which pin is connected to the female tie tack clasp 26.

Figure 4:
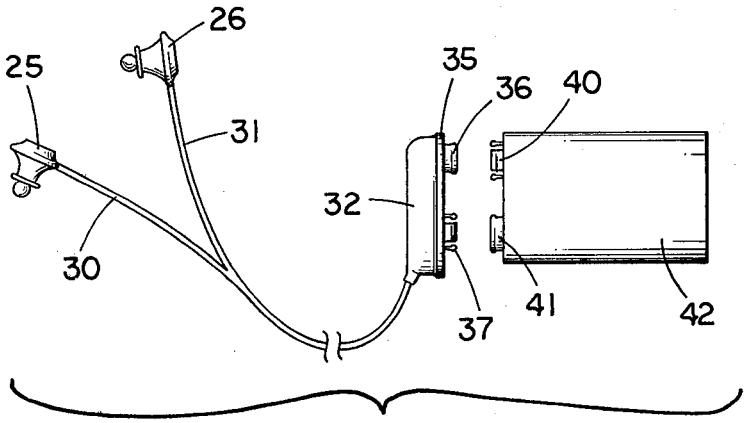
FIG. 4 is a perspective vew of the remaining portions of the decorative article of the present invention showing them in a broken apart position.
Figure 5:
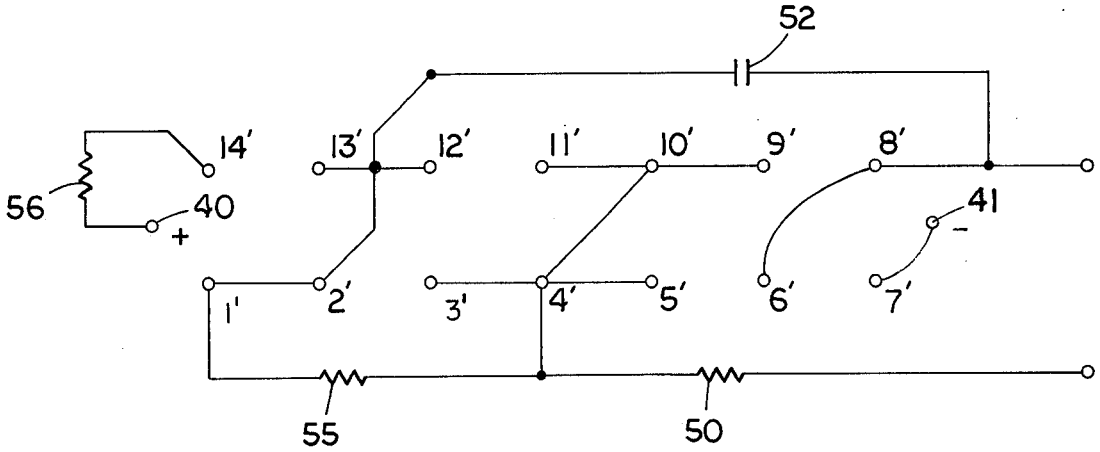
FIG. 5 is an electrical schematic diagram of the circuit of the decorative article of the present invention.

Referring more particularly to FIG. 4, the device further includes the female tie tack clasps 25 and 26, each of which is electrically connected to a flexible insulated electrical wire 30 and 31. The insulated wires 30 and 31 lead to an encapsulated electrical circuit 32 which is mounted on a printed circuit board 35 having a pair of electrical connectors 36 and 37 projecting therefrom and adapted to connect with the positive and negative terminals 40 and 41 of a battery 42. The dotted line 45 in FIG. 6 surrounds all of the electrical circuitry which is in the encapsulation 32. The purpose of FIG. 5 is to show the physical location of the various terminals of the specific integrated circuits which is used in the specific example illustrated herein. FIG. 6, on the other hand, shows the entire electrical circuit and shows the integrated circuit in a functional manner.

Figure 6:
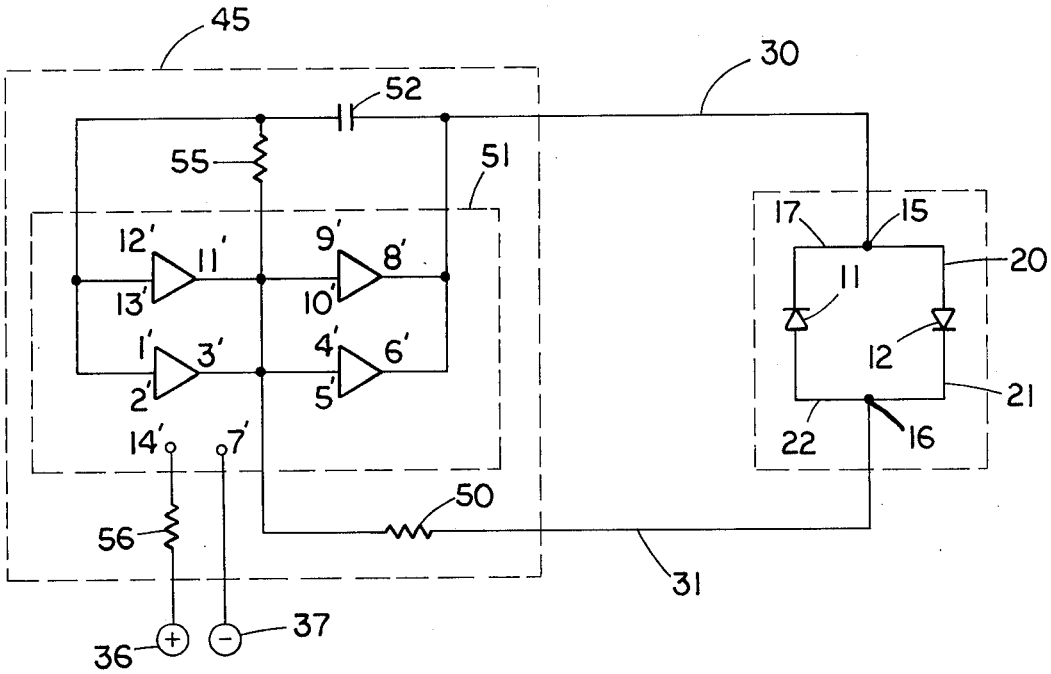
FIG. 6 is another electrical schematic diagram of the circuit of the decorative article of the present invention.

The purpose of the encapsulated electrical circuit 32, also indicated at 45 in FIG. 6, is to provide from the output lines 30 and 31 an electrical signal which is first positive on the line 30 with relation to the line 31 and then is positive on the line 31 with relation to the line 30 and then to repeat this cycle many times. Thus, the electrical circuit within the encapsulation 32 and the dotted line 45 is an oscillator and is provided with its power from the battery 42 which is a direct current battery.

Various oscillator circuits could be used in the present invention, and the illustrated circuit is only representative. The illustrated circuit does have the advantage that the lines 30 and 31 can be shorted out one to the other without harming or injuring the components of the circuit. This result is achieved by protecting the circuit with the resistor 50. In the illustrated specific embodiment of the invention the resistor 50 has a value of 1K ohms. This value might be varied in order to meet the parameters of the light emitting diodes 11 and 12. The circuit further includes a quad type NAND gate 51 which has the various terminals 1' through 14', inclusive, illustrated in FIGS. 5 and 6. The time constant of the oscillator is determined by the capacitor 52 and the resistor 55 which respectively have values in the specific embodiment of 0.022 microfarads and 22 megohms. A further resistor 56 is connected between the positive terminal 36 for the battery and the terminal 14' of the quad type NAND gate. The resistor has a value of 68 ohms in the illustrated specific embodiment. The specific quad type NAND gate used in the illustrated embodiment is a Type MM 74COON CMOS manufactured by National Semiconductor.

Figure 7:
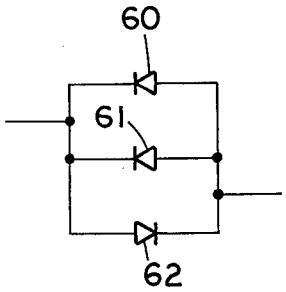
FIG. 7 is a schematic diagram of an alternative form of the circuit of the present invention.
Figure 8:
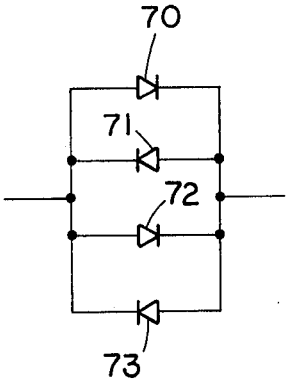
FIG. 8 is an electrical schematic diagram of still another circuit embodying the present invention.

Further alternative embodiments of the invention are illustrated in FIGS. 7 and 8. In FIG. 7 the light emitting diodes 60 and 61 both turn on at the same time and are both turned off at the same time. The light emitting diode 62 is turned off when the light emitting diodes 60 and 61 are turned on and vice versa. In other respects the embodiment of FIG. 7 is identical to that of FIGS. 1–6.

Referring to FIG. 8, there are provided four light emitting diodes 70, 71, 72 and 73. The light emitting diodes 71 and 73 are on when the light emitting diodes 70 and 72 are off and vice versa. In other respects the embodiment of FIG. 8 is identical to that of FIGS. 1–6. Still another embodiment of the invention might include only one light emitting diode connected across the lines 30 and 31 of FIG. 6 and replacing the two, three or four diodes mentioned above and their associated wiring.

It will be evident from the above description that the decorative article of the present invention is particularly easy to mount on the clothing because of the fact that the clasps 25 and 26 are connected together by flexible electrical wire which permits them to be moved toward one another and apart from one another. This fact facilitates the attachment of the clasps to the pins 15 and 16. The clasps 25 and 26 are conventional in that they may incorporate spring means which causes the clasps to better mechanically grip the pins 15 and 16 to better maintain the decorative article mounted on the clothing. This spring gripped arrangement also permits the clasps 25 and 26 to be individually manually released. An example of a suitable spring biased tie tack clasp is Tie Tack Clutch, Model Number 5051/1 marketed by Eastern Findings Corporation, 19 West 34th Street, New York, New York.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention and the scope of the claims are desired to be protected.

The invention claimed is:

1. A decorative article for wearing on the clothing comprising:

a. a pair of light emitting diodes connected electrically to one another with the cathode of one diode connected to the anode of the other diode and the anode of the one diode connected to the cathode of the other diode;

b. a button for display on the clothing, said light emitting diodes being mounted for display on said button;

c. a pair of pins attached to and projecting from said button for mounting said button on the clothing, one of said pins being electrically connected to the cathode of the one diode and the other of said pins being electrically connected to the anode of the one diode;

d. a pair of conductive, female fastener members both adapted to receive and to electrically connect with either of said pins for attaching said button to the clothing, said fastener members being separate from one another and capable of being moved toward and away from one another;

e. a pair of flexible, insulated electrical wires, each of said wires being electrically connected to a respective one of said female fasteners; and f. means for providing an electrical signal to said pair of wires for transmission of the signal through said female fastener members and said pins to said light emitting diodes, which signal causes a first of said members to have a positive voltage relative to a second of said members and then causes the second of said members to have a positive voltage relative to the first of said members.

2. The article of claim 1 wherein said means for providing an electrical signal comprises:

a battery; and an oscillator circuit powered by said battery, each of the wires of said pair of flexible insulated electrical wires leading to and from said oscillator circuit to one of said female fasteners.

* * * * *